US006039470A

United States Patent [19]

Conwell

[11] Patent Number: 6,039,470

[45] Date of Patent: Mar. 21, 2000

[54] PARTICULATE MIXING SYSTEM

[76] Inventor: Allyn B. Conwell, 17114 Silverthorne La., Spring, Tex. 77379

[21] Appl. No.: 08/823,454

[22] Filed: Mar. 24, 1997

[51] Int. Cl.[7] ..... B01F 5/10; B01F 15/02

[52] U.S. Cl. ..... 366/137; 366/153.1; 366/336

[58] Field of Search ..... 366/131, 132, 366/163.1, 163.2, 137, 153.1, 155.1, 159.1, 164.6, 167.1, 165.4, 165.5, 336; 422/281

[56] References Cited

U.S. PATENT DOCUMENTS

| | | | |
|---|---|---|---|
| 1,781,435 | 11/1930 | Carper | 366/137 |
| 2,900,176 | 8/1959 | Krogel | 366/137 |
| 4,319,848 | 3/1982 | Lambertini et al. | 366/136 |
| 4,407,431 | 10/1983 | Hutter, III | 366/137 |
| 4,664,528 | 5/1987 | Rodgers et al. | 366/137 |
| 4,671,892 | 6/1987 | Bereiter | 366/136 |
| 4,693,609 | 9/1987 | Haynes | 366/136 |
| 4,744,959 | 5/1988 | Punzar et al. | 366/167.1 |
| 4,778,280 | 10/1988 | Brazelton | 366/136 |
| 4,823,987 | 4/1989 | Switall | 366/137 |
| 5,046,855 | 9/1991 | Allen et al. | 366/137 |
| 5,052,486 | 10/1991 | Wilson | 366/136 |
| 5,137,694 | 8/1992 | Copeland et al. | 366/137 |
| 5,190,374 | 3/1993 | Harms et al. | 366/165.3 |
| 5,211,475 | 5/1993 | McDermott | 366/137 |
| 5,308,648 | 5/1994 | Prince et al. | 427/212 |
| 5,344,619 | 9/1994 | Larwick et al. | 366/167.1 |
| 5,634,715 | 6/1997 | Stehr et al. | 366/137 |

*Primary Examiner*—Tony G. Soohoo

[57] ABSTRACT

An improved system for mixing a dry particulate matter with a liquid. The system mixes the dry particles with a liquid to form a liquid mixture containing unwetted particles. The liquid mixture is placed in a settling tank so that the unwetted particles gravitate toward the bottom of the tank. The unwetted particles are withdrawn from the tank bottom and are pumped through a mixer which reduces the size of the unwetted particles and redirects the stream back into the tank. This process is manually or automatically reiterated until the liquid mixture becomes a homogeneous wetted material. By cycling the unwetted particles which are separated from the bulk of the liquid mixture, the system efficiently concentrates on the unprocessed and less processed portions of the liquid mixture. After processing is complete, the homogeneous wetted material can be discharged into a holding tank for distribution.

17 Claims, 2 Drawing Sheets

PARTICULATE MIXING SYSTEM

BACKGROUND OF THE INVENTION

The present invention relates to the field of mixing solid particles with a liquid such as water. More particularly, the invention relates to an apparatus and method for expediting mixing processes between a liquid and fine solid particles such as dry polymer.

In the oil and gas, petrochemical and manufacturing industries, dry powdered materials such as polymeric compounds are transported to a well site or other field locations to reduce shipping weight and to facilitate material handling procedures. After the dry material arrives at the site, the dry material must be hydrated with a liquid such as water to form the desired compound. Such compounds can comprise drilling, fluids, water clarifiers, flocculants, fracing gels, cements, and other useful compounds. To save transportation costs, the hydrating operations can also be conducted within industrial, commercial or construction locations after the dry material has been transported.

One area involving the hydration of dry powdered materials comprises the hydration of polymers. When polymer particles are mixed with a liquid such as water, the outer portion of the polymer particles wet instantaneously on contact, while the center remains unwetted. The outer wetted surface area forms a viscous shell which can restrict the wetting of the particle center. These partially wetted or unwetted particles are known as "fisheyes", and can be processed with mechanical mixers to reduce the unwetted particles into a homogeneous wetted mixture. However, mechanical mixing requires energy, degrades the molecular bonds of the polymer, and reduces the effectiveness of the polymer for the intended use. Consequently, a need exists for improved mixing systems that can effectively wet dry particles such as polymers without degrading such polymers.

Various techniques have been developed to hydrate dry polymeric powders. In U.S. Pat. No. 3,902,558 to Watson, Jr. (1975) and in U.S. Pat. No. 4,014,527 to Watson, Jr. (1977), polymer was sprayed through a nozzle against a sheet of water to contact and blend the polymer with the water. In U.S. Pat. No. 4,077,612 to Ricciardi (1978), a mixing chamber fed atomized polyelectrolyte particles into a turbulent, cyclonic water stream to create a turbulent wetting action. In U.S. Pat. No. 4,664,528 to Rodgers et al. (1987), an emulsion polymer was mixed with a conventional static mixer and was moved with various circulation means. In U.S. Pat. No. 4,688,528 to Brazelton et al. (1987), dry polymer was fed into a mixing chamber having a mechanical impeller, and the mixture was then moved to a lower aging chamber. In U.S. Pat. No. 4,764,019 to Kaminski et al. (1988), a two stage mixing tank system having a variable speed auger in the secondary mixing tank. In U.S. Pat. Nos. 4,845,192 and 4,874,588 to Sortwell et al. (1989), high shear forces were introduced on a dry polymer as water was introduced into a cyclone mixing device. In U.S. Pat. No. 5,344,619 to Larwick et al. (1994) a vortex chamber was used to mix dry polymer particles with water, and a mechanical agitator operated within a tank. In U.S. Pat. Nos. 5,372,421 (1994) and 5,470,150 (1995) to Pardikes, a polymer was mixed with water and the pressure was reduced to relax the polymer mixture.

Conventional mixing systems require significant energy, mechanical mixing and aging time to achieve a desired degree of particle hydration. Although such systems can be effective for certain types of dry powders, such the effectiveness of such systems is limited for dry powdered materials such as polymeric compounds. Accordingly, a need exists for an improved system which effectively and efficiently hydrates dry particles.

SUMMARY OF THE INVENTION

The present invention provides a system and method for hydrating dry powder material with a liquid to generate a homogeneous wetted material. The system comprises a disperser for mixing the dry powder material with the liquid to generate a mixture containing nonwetted particles and a settling tank engaged with the disperser for receiving the liquid mixture and for containing the liquid mixture as the nonwetted particles gravitate toward the lower end of the settling tank. A pump removes the nonwetted particles from the tank lower end, a mixer engaged with the pump processes the nonwetted particles to reduce the size of the nonwetted particles in a process stream, and a valve selectively discharges the homogeneous wetted material from the system. In one embodiment of the invention, the dry powder can comprise a polymer.

The method of the invention is practiced by mixing the dry powder material with the liquid to generate a liquid mixture containing nonwetted particles, by introducing the liquid mixture into a settling tank so that the nonwetted particles gravitate toward a lower end of the settling tank, by removing the nonwetted particles from the tank lower end with a pump, by introducing the nonwetted particles into a mixer to reduce the size of the nonwetted particles in the process stream, by discharging such process stream into the settling tank to create the homogeneous wetted material, and by selectively operating a valve to discharge the homogeneous wetted material.

DESCRIPTION OF THE PREFERRED EMBODIMENTS

Figure 1:
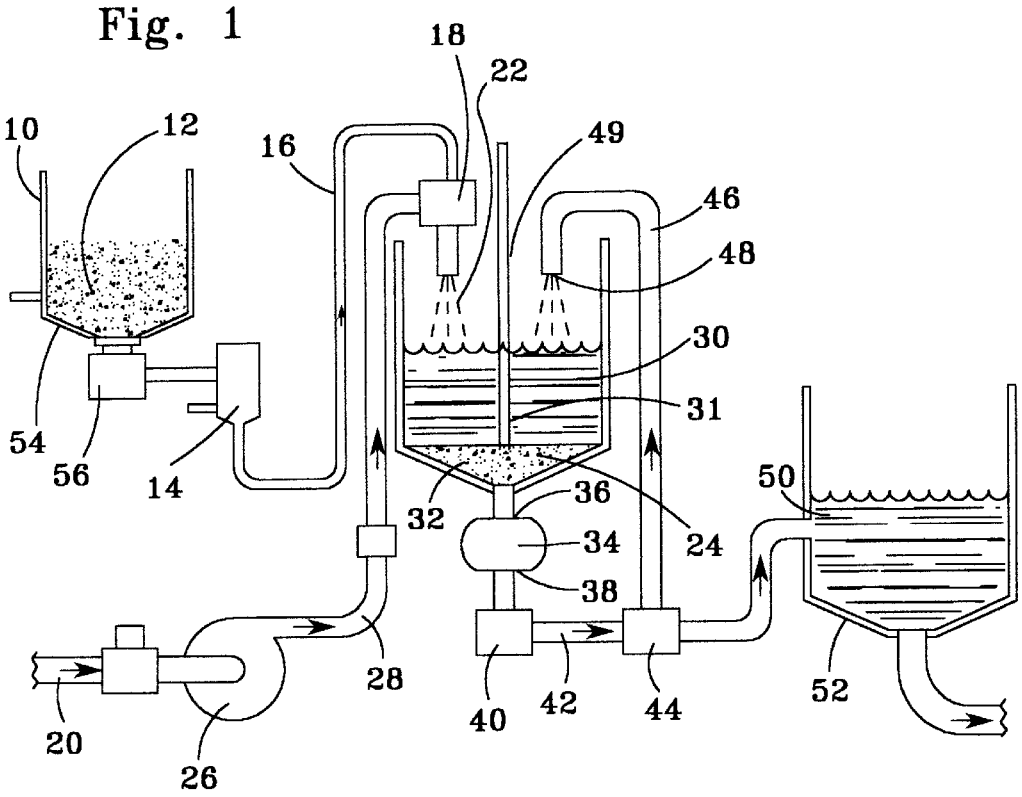
FIG. 1 illustrates a schematic view of the invention.

The present invention provides a unique system and method for hydrating dry powder material with liquid to generate a homogeneous wetted material. Hopper 10 initially contains dry powder material 12, and vacuum dispenser 14 mixes ambient air with dry powder material 12 to separate and to agitate the individual particles of dry powder material 12. The mixture of air and dry powder material 12 is transmitted through conduit 16 to disperser 18 such as a coaxial eductor, where dry powder material 12 is mixed with liquid 20 to generate liquid mixture 22 containing nonwetted particles 24. As defined herein, the term "nonwetted" means particles which are partially or nonuniformly wetted and have not been fully wetted to create a homogeneous product. Liquid 20 is supplied to disperser 18 through pump 26 and conduit 28.

Liquid mixture 22 is received by settling tank 30 engaged with disperser 18. Lower probe 31 can be positioned to detect a minimum level of liquid mixture 22 within tank 30. Because nonwetted particles 24 have a greater mass per unit than the remainder of liquid mixture 22, nonwetted particles 24 will gravitate toward lower end 32 of tank 30. Recirculation pump 34 having inlet 36 and outlet 38 receives nonwetted particles 24 from lower end 32 of tank 30 and discharges nonwetted particles 24 into mixer 40. The size of nonwetted particles 24 is reduced by mixer 40 and the resulting process stream 42 is transported through valve 44 and conduit 46 to be discharged through port 48 into tank 30. Upper probe 49 can be positioned to detect when tank 30 is full of liquid mixture 22, and can be connected with controls to prevent overfilling of tank 30. When liquid mixture 22 and the entrained nonwetted particles 24 are converted into a homogeneous wetted material 50, valve 44 is selectively operated to discharge homogeneous wetted material 50 into holding tank 52. Specific details of the system are further described below.

Hopper 10 initially stores dry powdered material 12 and can be supplied through conventional transport and loading techniques. Hopper 10 preferably isolates dry powdered material 12 from moisture and ambient humidity to prevent activation or agglomeration of the individual particles within dry powdered material 12. Sensor 54 can detect the storage level of dry powdered material 12 so that additional quantities can be added from the source as appropriate. Dry powdered material 12 can comprise any compound or material comprising small particles. Dry powdered material 12 can comprise polymers, organic particles, inorganic particles such as coal fines, cement, food products, plastics, fertilizers, dewatering compounds, waste recovery compounds, and other particulate materials.

Volumetric feeder 56 can precisely control and monitor the discharge rate of dry powdered material 12 from hopper 10. Feeder 56 can comprise various devices such as a cavity displacement pump or "star" feeder. Dry powdered material 12 is mixed with ambient air within dispenser 14 and the resulting combination is transported at relatively high velocity through conduit 16 to disperser 18. As previously stated, disperser 18 mixes liquid 20 with dry powdered material 12 to form liquid mixture 22. Liquid 20 can comprise water or any other suitable liquid or wetting agent. Disperser 18 can comprise many different devices suitable for merging liquid 20 and dry powdered material. In a preferred embodiment of the invention, disperser 18 can comprise a coaxial eductor. This configuration is particularly efficient for limiting agglomeration of particle clumps within disperser 18, and is advantageous for dry powdered material 12 such as polymer because negligible shear forces are exerted on the polymer. In other embodiments of the invention, disperser 18 can comprise a cyclone, a mechanical mixer, a spray nozzle, or other suitable contacting device suitable for contacting liquid 20 with dry powdered material 12.

Settling tank 30 forms a container for retaining liquid mixture 22, and further comprises a separation apparatus for separating nonwetted particles 24 from liquid mixture 22. For illustrative purposes, liquid mixture 22 can comprise a polymer mixed with water wherein a portion of liquid mixture 22 comprises homogeneous wetted material 50 and a portion of liquid mixture 22 comprises nonwetted particles 24. In this use, nonwetted particles 24 comprise fisheyes and other particles wherein the water has not evenly saturated the polymeric material. Such nonwetted particles 24 are more dense than the surrounding liquid within liquid mixture 22, and will be acted upon by gravity to move downwardly within liquid mixture 22 until nonwetted particles 24 collect at lower end 32 of tank 30. Because of this discovery, the invention uniquely withdraws the nonwetted particles 24 from tank 30 at the location having the highest concentration of nonwetted particles within liquid mixture 22. Nonwetted particles 24 are pumped through mixer 40 to further condition such particles and to further reduce the particle size of nonwetted particles 24.

Due to the unique system configuration and operation, the majority of liquid mixture 22, which has already reached a suitable conditioning level and has been converted into homogeneous wetted material 50, is not recirculated through mixer 40. Instead, the impact of mixer 40 is focused on nonwetted particles 24 to maximize the system efficiency in converting nonwetted particles 24 into homogeneous wetted material 50. This efficiency reduces processing time for the entire system and permits a higher degree of conditioning than is accomplished with conventional systems. In certain applications where a polymer is mixed with water, the system achieved one hundred percent conditioning status within thirty minutes of operation.

Recirculation pump 34 preferably comprises a low shear pump so that shear sensitive materials such as polymers are not unnecessarily degraded. Mixer 40 can comprise a conventional static mixer suitable for further processing of nonwetted particles 24. In a preferred embodiment of the invention suitable for polymers, mixer 40 preferably comprises an Aqua-Shear™ Model 300 opposing stream contact mixer distributed by Flow Process Technologies, Inc. Valve 44 can comprise a three-way valve for selectively discharging homogeneous wetted material 50 into holding tank 52. In this configuration, valve 44 discharges homogeneous wetted material 50 after all of such material has been moved through pump 34 and mixer 40. In other embodiments of the invention, valve 44 could be positioned upstream of mixer 40 or could be attached directly to settling tank 30 to permit the discharge of homogeneous wetted material 50.

Figure 3:
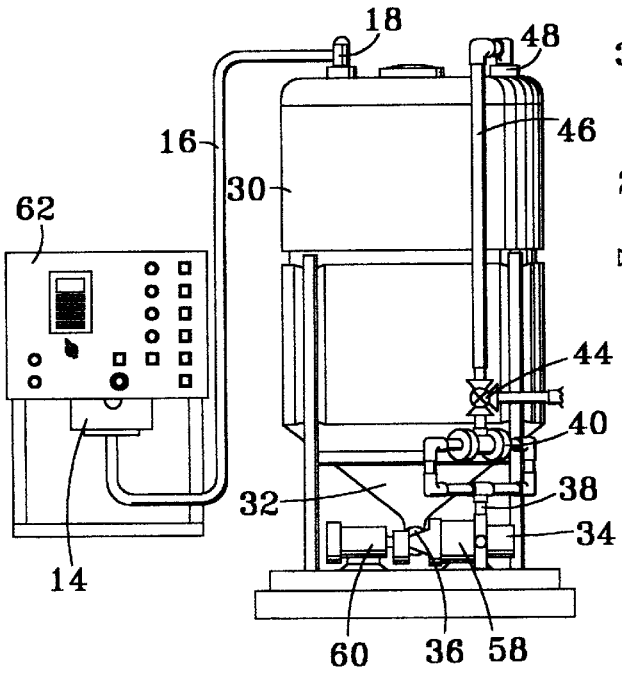
FIG. 3 illustrates an elevation view for one embodiment of the invention having a vertical settling tank with a conical lower end.
Figure 2:
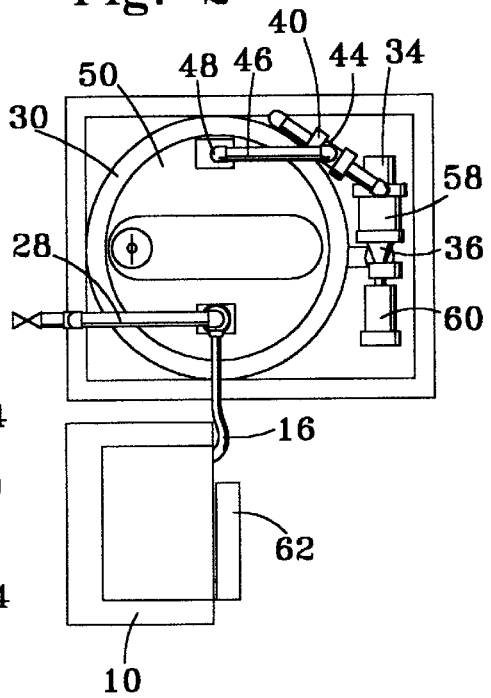
FIG. 2 illustrates a plan view for one embodiment of the invention.

As illustrated in the plan view shown in FIG. 2, the invention furnishes a compact system that can be skid mounted for transport and storage. Recirculation pump 34 is shown as gear pump 58 having an integral gear reducer, and powered with electric motor 60. Hopper 10 is illustrated as having a square intake and a particle screen over the open intake. Control panel 62 facilitates automated controls and operations as described below. FIG. 3 further illustrates one embodiment of the system components previously described, and further illustrates a preferred embodiment of lower end 32 for tank 30. Lower end 32 is preferably formed with sloped walls to guide nonwetted particles 24 to the bottom of tank 30, and to prevent clumping or agglomeration of nonwetted particles 24 as such particles gravitate toward lower end 32. In this fashion, nonwetted particles 24 are separated from the balance of liquid mixture 22 without additional energy provided by cyclones, centrifuges, mechanical mixers, or other conventional mechanical devices. By eliminating such mechanical mixers from the tank, aging and conditioning of liquid mixture 22 is facilitated, and system assembly and maintenance is simplified. As shown in FIG. 3, lower end 32 can comprise a cone shape leading to a central inverted apex. Alternatively, lower end 32 can be sloped in a single planar direction or can be formed in any configuration sufficient to encourage gravitation of nonwetted particles 24 toward a single collection place within tank 30.

Figure 4:
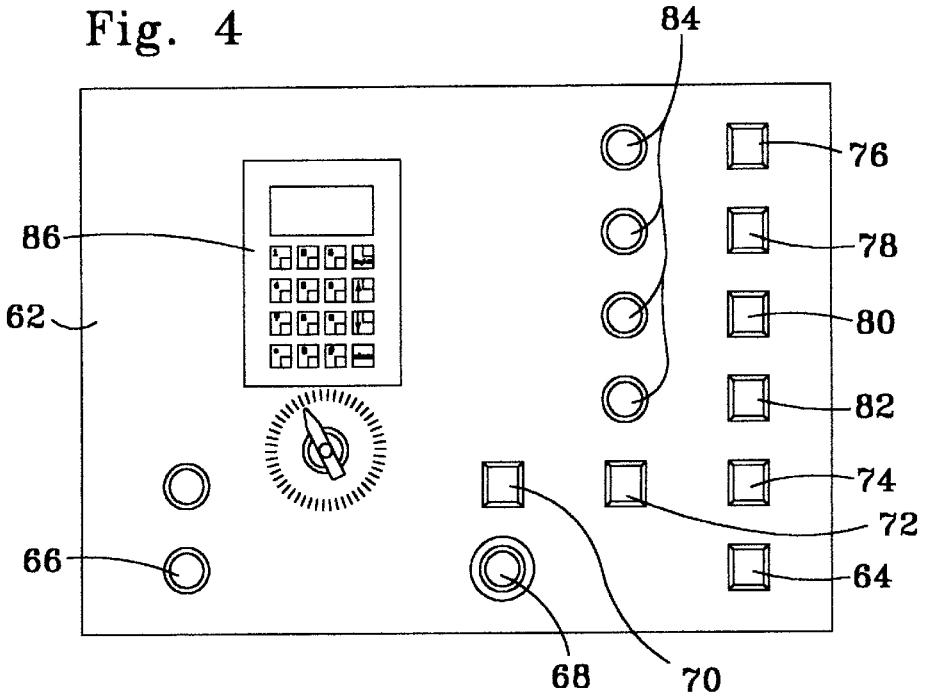
FIG. 4 illustrates one embodiment of a control panel.

FIG. 4 illustrates one embodiment of control panel 62 suitable for providing manual or automated control of the system. Primary power for the system is provided by switch 64. By pushing switch 64, control panel 62 is powered up and indicator light 66 is illuminated. Disconnect button 68 is activated and can be operated to close the system operation during normal operations or upon emergency interrupt conditions. Alarm light and reset switch 70 can indicate selected conditions as described below, lighted switch 72 can be operated to select automated system operation, and lighted switch 74 can be operated to select manual system operation.

Manual switch controls can facilitate active control of the system operations. Water switch 76 turns on a solenoid water valve and water boost pump (not shown), and can be disabled if high level probe 49 is activated by the level of liquid mixture 22 within tank 30. Feeder switch 78 turns on a feeder drive to move dry powdered material 12 toward disperser 18, and the feed rate can be controlled with variable rate switch 79. Recirculation switch 80 turns on pump 34 and controls valve 44 to recirculate nonwetted particles 24 through mixer 40 and back into tank 30. Transfer switch 82 turns on pump 34 and operates valve 44 to redirect homogeneous wetted material 50 to holding tank 52. Indicator lights 84 show the status of each manual switch mode, and further show the operation of automated modes as described below.

Keypad 86 permits programming for automated operation of the system. Keypad 86 is activated by pushing automatic switch 72. If the level of liquid mixture 22 in tank 30 is below lower probe 31, the system will automatically begin a mix cycle. Indicator light 84 for water will be activated, and water and dry powdered material 12 will be mixed with disperser 18 to generate liquid mixture 22. If the level of liquid mixture 22 is above lower probe 29 when the automatic cycle is selected, the feed components for water and dry powdered material 12 will go on standby until a transfer of homogeneous wetted material 50 is made to holding tank 52, and another mix cycle is initiated. From keypad 86, the rate and duration of circulation by pump 34 can be established, and the discharge of homogeneous wetted material 50 can be controlled so that a new cycle is initiated. Keypad 86 can permit preset times for feeder operation and for system circulation. Additionally, keypad 86 can monitor alarm and interrupt functions and can automatically convert to manual operation.

Alarm controls can be incorporated within the automated operation of the system to control product quality and to prevent spills and overflow conditions. Alarm sensors and controls can detect high and low conditions of liquid mixture 22 within tank 30, can detect low levels of dry powdered material 12 within hopper 10, can determine the failure of feed streams for the water and for the dry powdered material 12, and can sense blockages within the system. Upon the detection of any of these conditions, alarm light 70 is lit and an audible alarm horn can be activated. Additionally, any of these conditions can reset the automated function to a manual mode so that the condition does not create additional problems.

Figure 5:
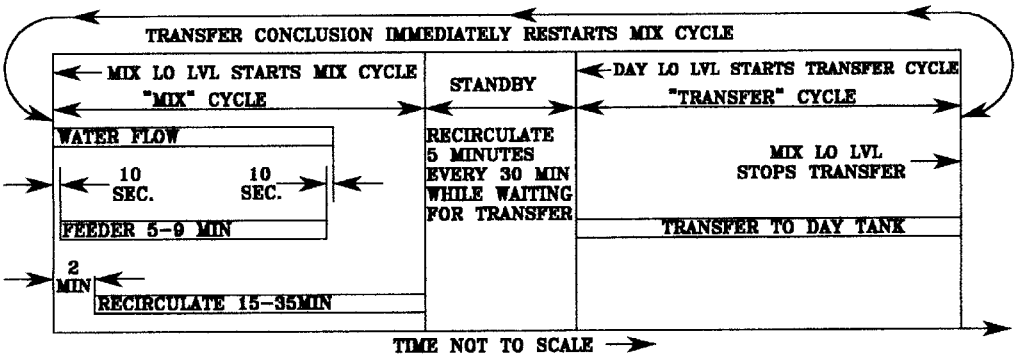
FIG. 5 illustrates a schematic flow chart showing automated system control.

FIG. 5 illustrates a diagram of system operation. Initially, water flow is opened and then the introduction of dry powdered material 12 into disperser 18 is begun to generate liquid mixture 22. This delay prevents dry powdered material 12 from accumulating within tank 30 without the presence of a liquid. After several minutes, pump 34 is initiated to begin recirculation operations. Dry powdered material 12 and water are continuously added until the selected quantity of each is achieved. The concentration of liquid mixture 22 within tank 30 will depend on the feed rates and feed duration for each of the water and of dry powdered material 12. After the selected time interval and wetted material 50, a standby mode can be initiated to recirculate homogeneous wetted material 50 at selected intervals until transfer of homogeneous wetted material 50 into holding tank 52 is made. Following such transfer, the mix cycle can be automatically restarted to begin a new batch process.

The invention provide the capability for a two tank mixing system wherein tank 30 provides the mix function and holding tank 52 can be incorporated by option to increase the deliverable flexibility of the system. Although the size and capability of the system can be changed to meet different mixing requirements, one embodiment of the invention provides for tank 30 capabilities between 500 and 2500 gallons, and holding tank 52 capabilities two or three lines larger. Precise flow rates are adjusted depending on the capacity of tank 30. The individual components within control panel 62 are rated and sized to each mixing application and will vary in voltage and horsepower ratings. Control panel 62 can incorporate programmable logic control to perform all logic control functions. As previously described, control panel 62 can monitor all peripheral components, level controls, keypad and message interfaces and lights, and switches.

In the automatic operation mode, the upper and lower level controls in tank 30 provide for system supervisory control. Similar upper and lower level controls can be positioned within holding tank 52 to automatically determine the need for operation of the mixing system. The high level controls provide an alarm function to disconnect intake of additional water and dry powdered material 12. When liquid mixture 22 is below the lower probe 31, a conductivity path is broken and a relay in control panel 62 is activated. When liquid mixture 22 touches or rises above lower probe 31, such relay is de-energized. Lower probe 31 is preferably positioned near lower end 32, and upper probe 49 is preferably placed near the top of tank 30 to prevent spillover. In automatic operation, the lower probe 31 initiates the mixing sequence where water and dry powdered material 12 are combined to generate liquid mixture 22. In polymer mixing operations, recirculation times in a range between fifteen and thirty minutes are suitable to convert liquid mixture 22 into homogeneous wetted material.

The mix cycle has priority over a transfer cycle, and a transfer cycle is not ordinarily initiated until the mix cycle is complete. If the level of liquid mixture 22 is reduced below lower probe 31 during the mix cycle, additional liquid mixture 22 is added to tank 22 for mixing and conditioning before the transfer cycle is initiated. The amount of recirculation after the addition of new liquid mixture 22 during the mix cycle can be manually controlled or can be automatically controlled through control panel 62.

The present invention uniquely provides a system and method for mixing dry powdered material with a liquid such as water. The invention is particularly suitable for efficiently and consistently mixing polymers with water without adversely reducing the capabilities of the polymer molecules. Blockages within the system components are substantially avoided, and the processing efficiency of the system is significantly increased by recirculating the larger particle sized nonwetted particles 24 within liquid mixture 22. The portions of liquid mixture 22 requiring least need of mixing continue to reside within tank 30, or are circulated proportionately less through mixer 40 than are the nonwetted particles 24 which gravitate toward tank lower end 32.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A system for hydrating a dry powder material with a liquid to generate a homogeneous, wetted material, comprising:

a disperser for mixing the dry powder material with the liquid to generate a liquid mixture containing nonwetted particles within said liquid mixture;

a settling tank having an upper end and a lower end, wherein said settling tank is engaged with said disperser for receiving said liquid mixture and for separating said nonwetted particles from said liquid mixture as said nonwetted particles gravitate toward said tank lower end;

a pump having an inlet proximate to and in communication with said tank lower end for removing said nonwetted particles from said tank lower end and further having a pump outlet for discharging said nonwetted particles;

a mixer having a mixer inlet engaged with said pump outlet for processing said nonwetted particles to reduce the size of said nonwetted particles in a process stream, wherein said mixer further has a mixer outlet for discharging said process stream into said settling tank to create the homogeneous wetted material; and a valve for selectively discharging the homogeneous wetted material.

2. A system as recited in claim 1, wherein the dry powder material comprises a polymer.

3. A system as recited in claim 1, wherein said disperser comprises a coaxial eductor having a body for conveying the liquid, and wherein said body has a longitudinal axis coincident with a nozzle for dispersing the dry power material into contact with the liquid.

4. A system as recited in claim 1, further comprising a dispenser for mixing ambient air with the dry material before the dry powdered material is mixed by said disperser.

5. A system as recited in claim 4, wherein said dispenser comprises a vacuum dispenser.

6. A system as recited in claim 1, wherein said pump comprises a low shear pump.

7. A system as recited in claim 1, wherein said mixer comprises an opposing stream contact mixer.

8. A system as recited in claim 1, further comprising a storage tank engaged with said valve, and wherein said valve is connected between said mixer outlet and said settling tank for selectively discharging the homogeneous wetted material into said storage tank.

9. A system as recited in claim 1, further comprising a control means engaged with said valve for selectively operating said valve to discharge the homogeneous wetted material from said settling tank.

10. A system as recited in claim 1, wherein said settling tank has interior walls which slope toward said settling tank lower end to facilitate gravitation of said nonwetted particles toward said tank lower end.

11. A system for hydrating a dry polymer with a liquid to generate a homogeneous viscous liquid, comprising:

a disperser for mixing the dry polymer with the liquid to generate a liquid mixture containing nonwetted particles within said liquid mixture;

a settling tank having an upper end and a lower end, wherein said settling tank is engaged with said disperser for receiving said liquid mixture and for separating said nonwetted particles from said liquid mixture as said nonwetted particles gravitate toward said tank lower end;

a pump having an inlet proximate to and in communication with said tank lower end for removing said nonwetted particles from said tank lower end and further having a pump outlet for discharging said nonwetted particles;

a mixer having a mixer inlet engaged with said pump outlet for processing said nonwetted particles to reduce the size of said nonwetted particles and to generate a viscous liquid, wherein said mixer further has a mixer outlet for discharging the viscous liquid into said settling tank; and a valve for selectively discharging the viscous liquid from said settling tank.

12. A system as recited in claim 11, further comprising a holding tank engaged with said valve for receiving said viscous liquid.

13. A system as recited in claim 11, wherein said pump comprises a low shear pump.

14. A system as recited in claim 11, further comprising a control means engaged with said disperser, said tank, said pump and said valve for metering the quantity of dry polymer and liquid introduced into said liquid mixture, for monitoring the liquid mixture level within said tank, for operating said pump to control the processing of said nonwetted particles, and for operating said valve to discharge said viscous fluid.

15. A method for hydrating a dry polymer with a liquid to generate a homogeneous wetted material, comprising the steps of:

mixing the dry powder material with the liquid to generate a liquid mixture containing nonwetted particles;

introducing the liquid mixture into a settling tank;

separating the nonwetted particles from the liquid mixture as the nonwetted particles gravitate toward the settling tank lower end;

removing the nonwetted particles from the settling tank lower end with a pump;

introducing the nonwetted particles into a mixer to reduce the size of the nonwetted particles in the process stream;

discharging such process stream into the settling tank to create the homogeneous wetted material.

16. A method as recited in claim 15, further comprising the step of selectively operating a valve to discharge the homogeneous wetted material.

17. A method as recited in claim 16, further comprising the step of automatically mixing additional dry powder with additional liquid to generate a new liquid mixture after said homogeneous wetted material is discharged.

* * * * *